United States Patent [19]

Schnegg

[11] Patent Number: 4,520,636

[45] Date of Patent: Jun. 4, 1985

[54] WOVEN-LIKE WARP KNIT FABRIC WITH TENSION CONTROL FOR TOP EFFECT YARN

[75] Inventor: Julius R. Schnegg, Burlington, N.C.

[73] Assignee: Burlington Industries, Inc., Greensboro, N.C.

[21] Appl. No.: 297,963

[22] Filed: Aug. 31, 1981

Related U.S. Application Data

[63] Continuation-in-part of Ser. No. 97,972, Nov. 28, 1979, Pat. No. 4,395,889.

[51] Int. Cl.[3] ..... D04B 23/08

[52] U.S. Cl. ..... 66/192; 66/209; 66/213

[58] Field of Search ..... 66/190-195, 66/202, 213, 209, 210, 132

[56] References Cited

U.S. PATENT DOCUMENTS

| | | | |
|---|---|---|---|
| 1,043,309 | 11/1912 | Fessmann et al. . | |
| 1,790,553 | 1/1931 | Peterson . | |
| 1,831,964 | 11/1931 | Lombardi | 66/191 X |
| 2,232,532 | 2/1941 | Hunter | 66/202 |
| 2,537,476 | 1/1951 | Moessinger . | |
| 2,680,364 | 6/1954 | Wickardt et al. . | |
| 3,036,448 | 5/1962 | Cundiff | 66/195 X |
| 3,084,529 | 4/1963 | Scheibe | 66/193 |
| 3,340,903 | 9/1967 | Golobat . | |
| 3,348,582 | 10/1967 | Brookshire . | |
| 3,511,064 | 5/1970 | Major et al. | 66/125 |
| 3,633,711 | 1/1972 | Pfarrwaller . | |
| 4,189,931 | 2/1980 | Groshens | 66/193 |
| 4,197,725 | 4/1980 | Kohl | 66/213 |
| 4,277,527 | 7/1981 | Duhl | 66/190 X |
| 4,285,216 | 8/1981 | Duhl | 66/193 |

FOREIGN PATENT DOCUMENTS

| | | | |
|---|---|---|---|
| 2362481 | 6/1975 | Fed. Rep. of Germany . | |
| 2420612 | 9/1976 | Fed. Rep. of Germany | 66/84 A |
| 2545384 | 9/1976 | Fed. Rep. of Germany | 66/85 A |
| 1334203 | 6/1963 | France . | |
| 512075 | 1/1955 | Italy . | |
| 430022 | 8/1967 | Switzerland | 66/193 |
| 871815 | 7/1961 | United Kingdom | 66/210 |
| 1165109 | 9/1969 | United Kingdom | 66/213 |

OTHER PUBLICATIONS

Paling, "Warp Knitting Technology", 1952, London, 2nd Ed., p. 152.

*Primary Examiner*—Ronald Feldbaum
*Attorney, Agent, or Firm*—Cushman, Darby & Cushman

[57] ABSTRACT

An improved warp knit fabric that can use conventional warp knit base fabric constructions or instead produce novel sheer base fabrics and apply top effect yarns in the warp direction to produce novelty effects using standard yarn ends. Also, full weight, self-lined fabrics can be formed. This top effect yarn can be fed with varying tension control so that a relatively wide variety of effects can be created together with base fabric which is chosen.

32 Claims, 15 Drawing Figures

WOVEN-LIKE WARP KNIT FABRIC WITH TENSION CONTROL FOR TOP EFFECT YARN

This application is a continuation-in-part of Ser. No. 097,972, filed Nov. 28, 1979, now U.S. Pat. No. 4,395,889.

BACKGROUND OF THE PRESENT INVENTION

Warp knitting, as known for many years, constitutes a type of knitting in which the yarns generally run lengthwise in the fabric. Yarns are prepared, as warps, on beams with one or more yarns being fed to each needle. Exemplary fabrics made by this type of knitting are tricot, milanese and raschel as well as mali type fabrics. Milanese knit fabrics constitute a type of run-resistant warp knit fabrics that exhibit a diagonal rib effect using several sets of yarns to make the fabric. Raschel knit fabrics can be made in plain or jacquered patterns with the latter being made to exhibit intricate eyelet and lacey patterns and is sometimes used as underwear fabric. Raschel fabrics are coarser than other types of warp knit fabrics and raschel type knitting machines have one or two sets of latch needles or compound needles and up to 48 sets of guides. Tricot fabrics are another type of run-resistant warp knit fabric in which either single or multiple sets of yarns have been used to produce the fabric.

It has also been known in the past to lay-in surface effect yarns but the present invention concerns a particular method of laying-in surface effect yarns in order to produce particularly highly styled novelty fabrics which are well designed for use as drapery fabrics.

Mali type machines use horizontal compound needles which stitch through a separate backing or through a separate layer of yarns to produce a variety of fabric constructions.

SUMMARY OF THE PRESENT INVENTION

The present invention comprises a method, the apparatus for accomplishing the method and several resulting novelty effect fabrics formed using standard knitting techniques. The fabrics appear to incorporate specialized novelty yarns that extend in the warp direction but, in fact, do not. The resulting fabrics constitute warp knit fabrics that produce a variety of outward visual appearances some being similar to a woven fabric while others are capable of producing a wide variety of novel effects. Further, specialized tensioning equipment, used on a creel which supplies the top effect novelty yarn, controls the feeding of that effect yarn in a way that allows tension to be increased or decreased in a random or predetermined manner so that the effect yarn assumes the appearance of being a slub yarn or creates the appearance of having irregular and changing amounts of yarn secured to the fabric. In particular, the present invention has found a way to take a standard yarn, varying in size from single yarns to roving or various other thick or thin yarns or combinations of yarns and form that yarn into a ratine like effect yarn. In fact, the effect yarn is not only made to appear as a slub yarn but is also provided with a wavey or wiggle type of outward appearance. Further, tension control over that effect yarn and how many chain warps it wraps around can also vary the resulting design by even changing the position of the chain warps.

The present invention also concerns the production of a combination of novel fabrics using various ones or combinations of the laid in or effect yarns or yarn patterns referred to herein each of which begin with and include a base fabric of either the novel woven-like type described or any one of various other base warp knit base fabric constructions. The woven-like base fabric is preferably produced on a Raschel machine where individual weft or fill ends are not inserted while various other types of warp knit base fabrics could be produced on a Raschel machine where individual weft or fill ends are introduced. The base fabric is usually a sheer type material which serves as a substrate for the other fabrics. Further, by applying backing yarns to any of the base fabrics, a fuller and heavier weight fabric is produced any of which can have a self-lining extending across the entire rear face of the fabric that is integrally knit in place. Also, any of the base fabrics on which top effect yarns can be placed either with or without the self-lining applied to the rear face results in an attractive possibly array of fabric constructions which can range from those that are very sheer to those that are possibly very fully and dense.

The new sheer fabric with a woven-like effect, which forms part of this invention, itself includes a plurality of groups of yarns which are designed so that the resulting fabric has the outward appearance of being woven. This appearance is carried over into the full weight fabrics comprised of the base fabric plus either or both of the backing and top effect yarns. Also, because the base fabric is used in each of the other fabrics there is no down time for the machine when changing fabric styles or types.

Prior to this present invention, it was not possible to create special effects in a warp knit fabric in the warp direction that exhibited or occurred in an irregular frequency across the fabric except by laying in pre-made yarns of that description. Under normal warp knitting operations such irregular patterning, especially of top effect yarns directly on the machine during knitting using otherwise regular yarns, was not possible.

Accordingly, the present invention has extended the range of novelty effects achievable with warp knit fabrics and incorporates means for creating and creatively using irregular tensions in a controlled or random manner. In addition, this tension control can be applied to each top effect yarn or only to certain selected ones across the width of the fabric in order to produce a wide variety of surface effects. Thus, it is possible with the present invention to produce a unique novelty yarn effect on warp knit goods directly on the warp knitting machine during knitting without using novelty yarns in the warp direction. Further, it is possible to produce a warp knit base fabric by use of special lay in patterns that exhibits the appearance of being woven on which the novelty yarn effect can also be placed. Further, the present invention increases the amount of yarn bulk that may be knit into a fabric which is especially desirable with a number of fabric end uses, such as in drapery fabrics since extra weight and density are desirable. Fabrics produced by this invention have a variety of end uses including use as drapery fabric, outer wear, home furnishing fabrics or other textile applications.

Other objects, features and characteristics of the present invention as well as the methods and operation and function of the related apparatus will become more apparent upon consideration of the following detailed description and the appended claims with reference to the accompanying drawings, all of which form a part of this specification, wherein like reference numerals designate corresponding parts in the various figures.

BRIEF DESCRIPTION OF THE DRAWINGS

In the drawings:

FIG. 7 is a photograph of the sheer base fabric produced according to the present invention which includes the yarns shown in FIGS. 4 and 5 together with chain stitches;

DETAILED DESCRIPTION OF THE PREFERRED EMBODIMENT OF THE PRESENT INVENTION

Figure 1:
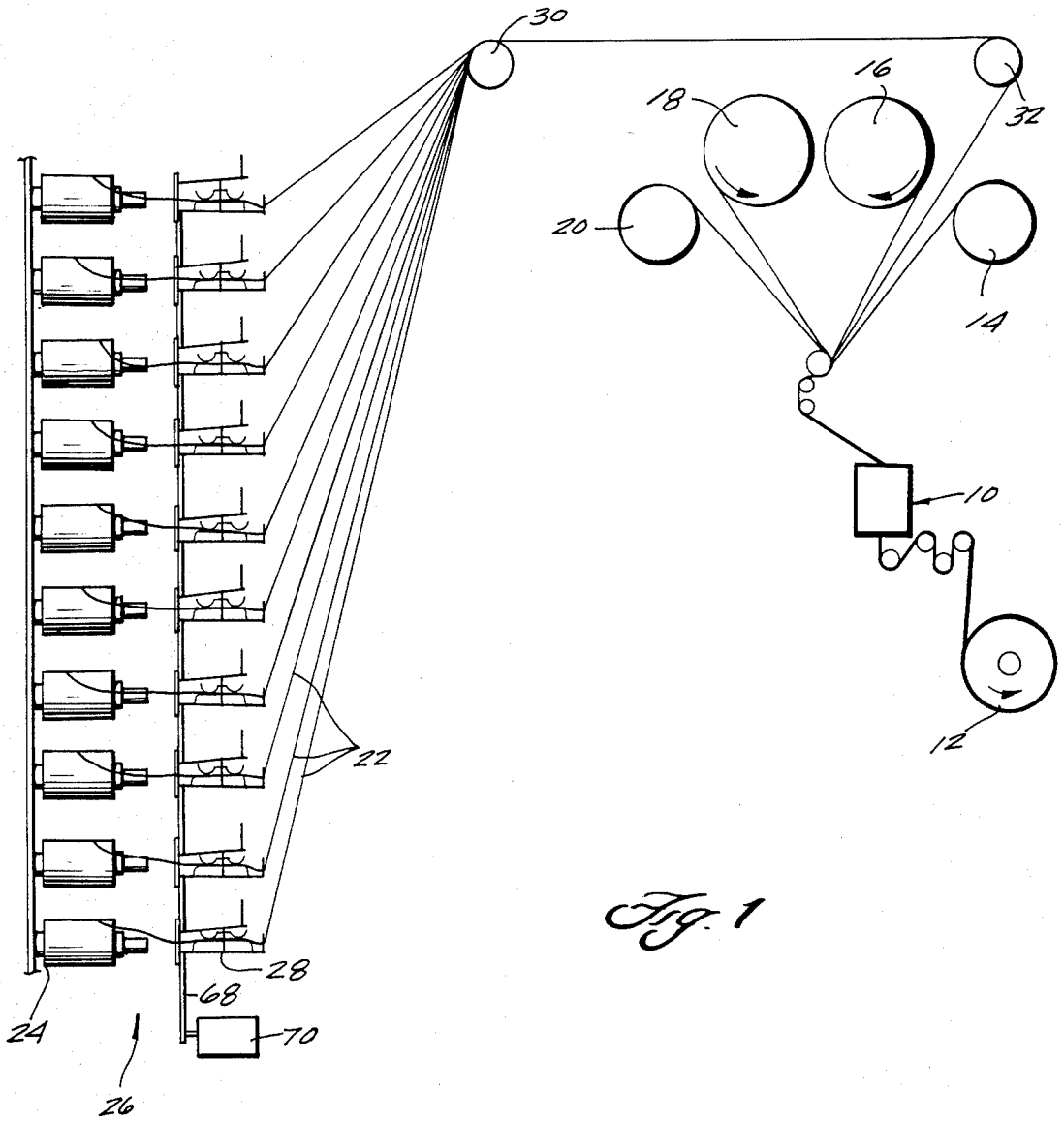
FIG. 1 is a diagrammatic side elevational view of the warp knitting machine arrangement used in the present invention together with a diagrammatic showing of a portion of the creel used to support packages containing the top effect yarn.

Turning now to FIG. 1, a side elevational view of the apparatus diagrammatically shows the warp knitting machine, generally indicated at 10, and the resulting warp knit fabric being taken up on a beam indicated at 12. Warp yarns are fed to the knitting machine 10 from beams indicated at 14, 16, 18 and 20, respectively, which are supported on the warp knitting machine in a conventional manner.

As will be more fully explained hereafter, one type of base, ground or sheer fabric produced in accordance with the present invention will be comprised of three groups of yarns, specifically, one group of yarns forming a plurality of chain stitches, a second group of ground or base yarns that tie the chain stitches together and a third group of weave effect yarns which together with the ground yarns create the visual appearance of a woven fabric. For example, the chain stitches can be supplied from beams 14 while the ground and weave effect yarns, respectively, can be supplied from beams 16 and 18.

In producing a more full or heavier fabric, such as drapery or other heavy household furnishing fabrics, a separate backing material is usually separately applied to drapery fabrics previously manufactured adding expense and additional processing steps. However, in the present invention the sheer material can be provided with a self-lining by introducing a fourth group of yarns, referred to as backing yarns and the backing yarns can be supplied, for example, from beams 20 so as to integrally form a backing as the fabric is being manufactured.

The full weight fabric can also include top effect yarns indicated in FIG. 1 at 22, which are supplied from packages 24 held on a creel diagrammatically indicated at 26. Top effect yarns 22 will be pulled off of packages 24 and passed through tensioning devices, generally indicated at 28, from which they will pass around guide rollers 30 and 32 and then to the knitting machine bar controlling this placement in the knit fabric.

It should be pointed out that the warp knitting machine generally indicated at 10 can be a Mayer machine made by the Karl Mayer Textil-Maschinen Fabrik-GMBG D-6053 Obertshausen, West Germany or the Mayer Textile Machine Corp., 7102 Sherwin Road, Greensboro, N.C. 27410, type RM6-G-EV. Likewise, creel 26 can be a Mayer draw-off creel which is a conventional piece of equipment. It is submitted that further description of the creel arrangement and the warp knitting machine are not required for one skilled in the art to fully understand the present invention and accordingly no further description will be provided herein.

Figure 2:
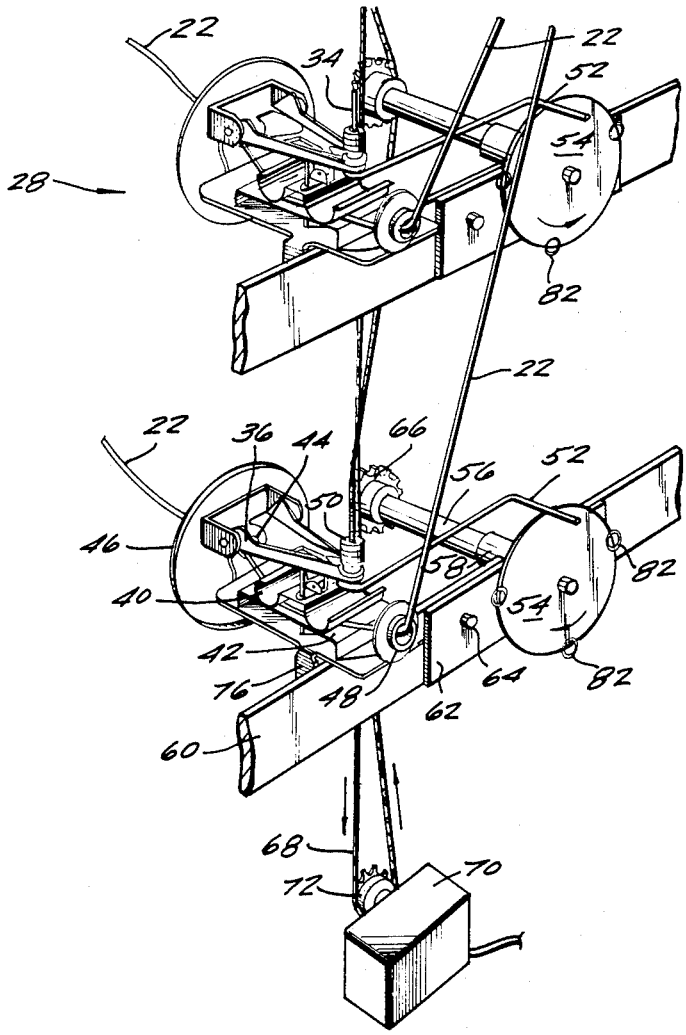
FIG. 2 is a detailed perspective of a portion of the top effect yarn tensioning device as mounted on the creel.
Figure 3:
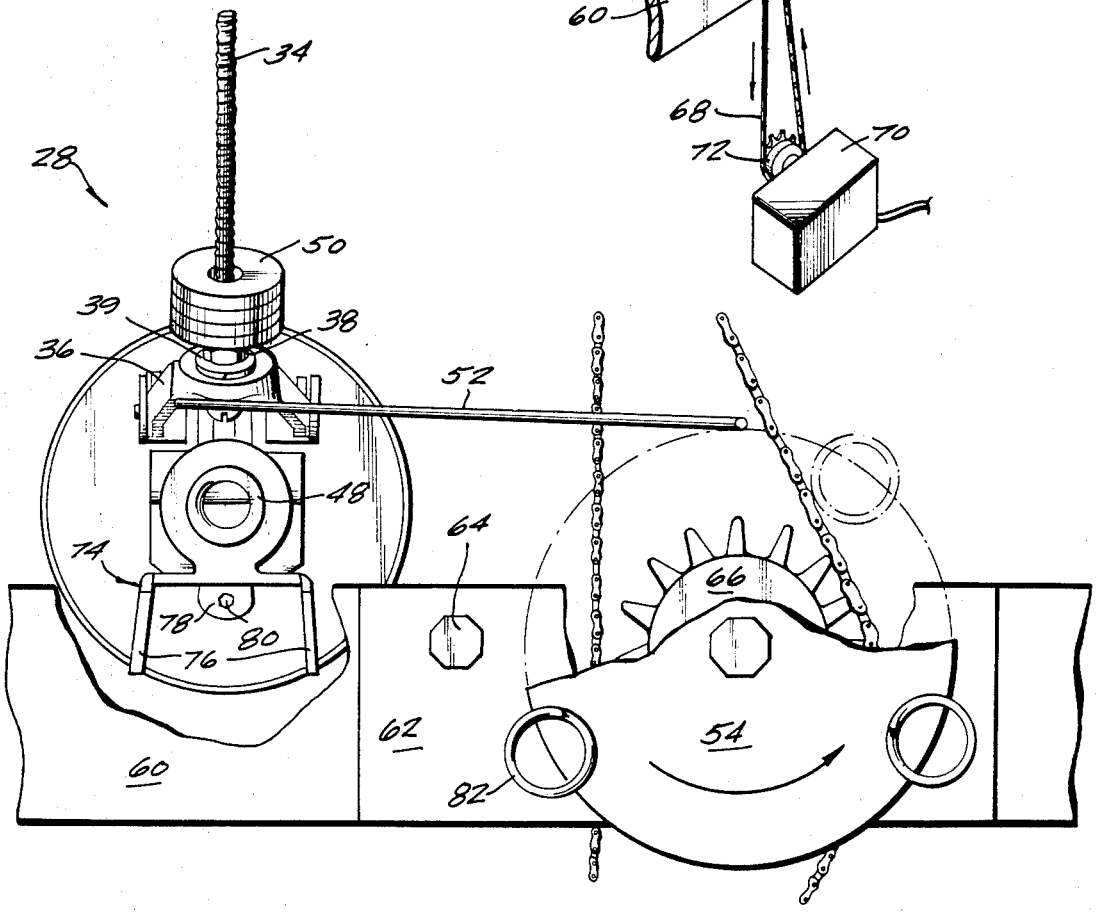
FIG. 3 is an enlarged front elevational view of one of the tensioning assemblies shown in FIG. 2 with portions cut away for clarity.

The tensioning devices 28 are shown in greater detail in FIGS. 2 and 3 and attention is now directed to those figures. The major portion of this tensioning device is a type BFS Mayer Leaf Spring Threadbrake. This threadbrake tensioning device, however, has been modified by incorporating bolt 34 in the pivotally mounted spring support arm 36 and is held in place by a nut 38 and lock washer 39. As shown in FIG. 2, a double leaf spring 40 is secured to the bottom side of support arm 36 and when support arm 36 is in its down or rest position, the double leaf spring 40 engages the upper surface of a spring plate 42. Yarn 22, as shown in FIG. 2, will enter through a rear guide hole 44 provided in guide plate 46 and will pass through the device between double leaf spring 40 and spring plate 42 and will exit from a front guide 48. From guide 48, yarn 22 will pass upwardly as shown in FIG. 1 toward guide rollers 30 and 32. Bolt 34 is extra long so that a large number of weight disks 50 can be slid down bolt 34 and together apply tension or pressure on the yarn 22 by applying force on double leaf spring 40 as it rests against spring plate 42. How many disks 50 are used will vary with the yarn being used and the effects desired, but should not be so great that stitches in the fabric will be broken.

The application of tension to top effect yarn 22 is controlled by means of lever arm 52 and cam 54. Cam 54 is mounted on a shaft 56 by any convenient means and shaft 56 is rotatably supported within a mounting collar 58 which is itself secured to one of the horizontal creel frame structural elements 60 by means of a mounting plate 62 and bolts 64. A drive gear 66 is secured to the other end of shaft 56 and is drivingly engaged by drive chain 68 which in turn is driven by drive motor 70 and a main drive gear 72. As shown in FIG. 1, ten tension devices 28 are usually located in each vertical row along the creel frame and one motor 70 will be provided for each vertical row. Also, the number of vertical rows can vary depending upon the number of top effect yarns being used.

As shown in FIG. 2, drive chain 68 alternates back and forth about drive gears 66 so that alternating cams 54 are driven in opposite directions as indicated by the arrows on the two cams 54 shown in FIG. 2. It should also be pointed out that tension device 28 is itself mounted on creel frame element 60 by a mounting bracket, generally indicated at 74, comprised of a pair of rear mounting legs 76 which extend over the backside of element 60 and a front mounting arm 78 which fits over the front of element 60. A set screw 80 is included in arm 78 and will, when tightened, bring legs 76 into engagement with element 60, thus securing tensioning device 28 thereto.

Lever arm 52 is connected to the pivotal support arm 36 by bolt 34 and the raising and lowering of lever arm 52 will likewise raise and lower the pivotal supporting arm 36 and leaf spring 40. Cam 54 can be shaped to include camming surfaces, but I have found it is preferable to employ split rings 82 spaced at predetermined locations about the periphery of cam 54 in order to provide the camming action for lever arm 52 once the proper location for these has been selected.

It should also be pointed out that movement of lever arm 52 could be controlled by solenoids under the control of a randomizer circuit as described in U.S. Pat. Nos. 3,748,648 and 3,868,496.

The number of weight disks 50 that are needed will vary on the size and texture of the yarn being fed. However, the amount of weight should be enough to allow the yarn to be fed and yet produce the affects desired. In that regard, attention is directed to FIG. 8 where a fabric produced according to the present invention is shown. It is possible to see variations in the effects obtained in the top effect yarn. For example, there is one group of three yarns where the tension applied appears to be relatively uniform indicating that tension has been substantially constant and that cam 54 has not raised and lowered lever arm 52 to vary tension. Another group of darker yarns appear to have thick and thin areas so that the overall appearance is that the yarns exhibit slubbed and non-slubbed areas. The areas where the yarn has the appearance of being slubbed will have been produced when lever arm 52 has been raised by one of the split rings 82 or by a cam surface if cam 54 were provided with cam surfaces. During the non-slubbed areas in the remaining length of the yarn (i.e., between slubbed areas), lever arm 52 will have been in its lowered position and tension has been applied by disks 50. It should also be noticed that the guide bar on the warp machine has been moved in the cross-machine direction or has been shogged back and forth across one wale. A typical shogging program is 0-0/0-0/2-2/2-2//. While this top effect yarn has been introduced onto the technical back of the knit fabric, that surface becomes the outer or front face or surface of the fabric in its finished form.

While a wide variety of yarn types could be used as this top effect yarn, one particular type I have found to produce desirable effects is a yarn formed with a ten singles yarn as a core and a roving yarn parallel plied or wrapped therearound and later twisted with six singles so as to produce a torque free yarn. By using such a yarn and by having it moved back and forth across a single wale, and also by employing the tensioning device discussed hereinbefore, it is possible to take a straight yarn, of really any weight, count or denier, and produce a ratine like effect on the fabric. The above yarn can be identified also as a 386 pounds/lb. roving yarn and by varying the placement of the camming surfaces on cam 54, it is possible to produce specialized novelty effects across the surface of the fabric in an irregular frequency without using a specialized yarn. Further, this method and apparatus provides a way of producing warp knit fabric containing irregular patterning not otherwise possible.

Figure 5:
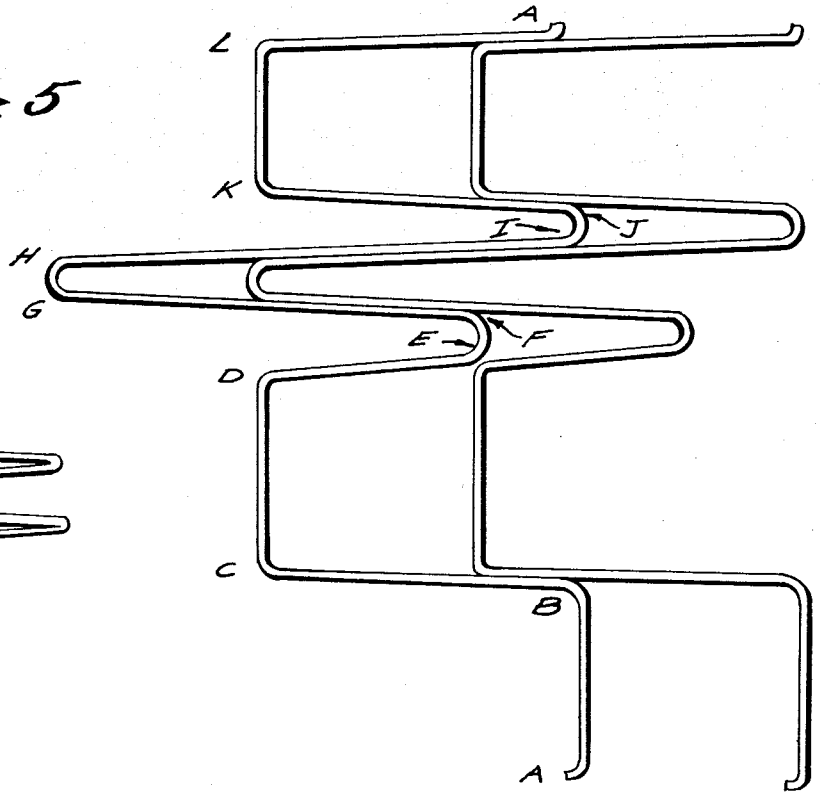
FIG. 5 is a diagrammatic showing of two repeats of the weave effect yarn used to produce the fabric made according to the present invention.
Figure 4:
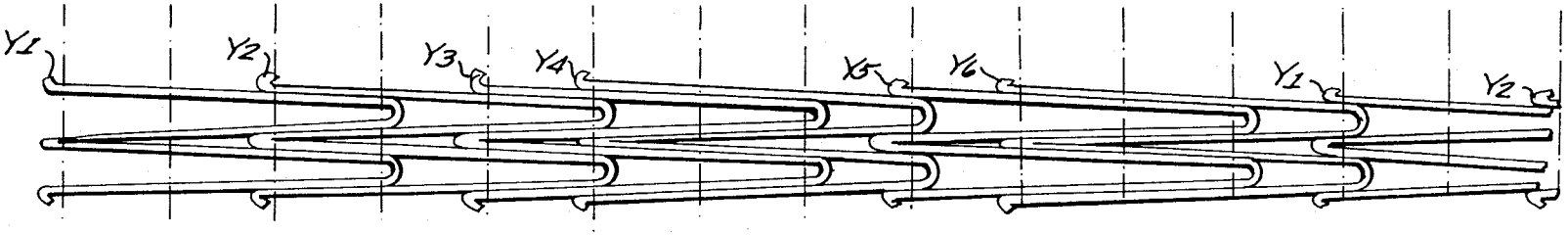
FIG. 4 is a diagrammatic showing of the pattern repeat in two courses of the ground yarn used in the fabric produced according to the present invention.
Figure 1:
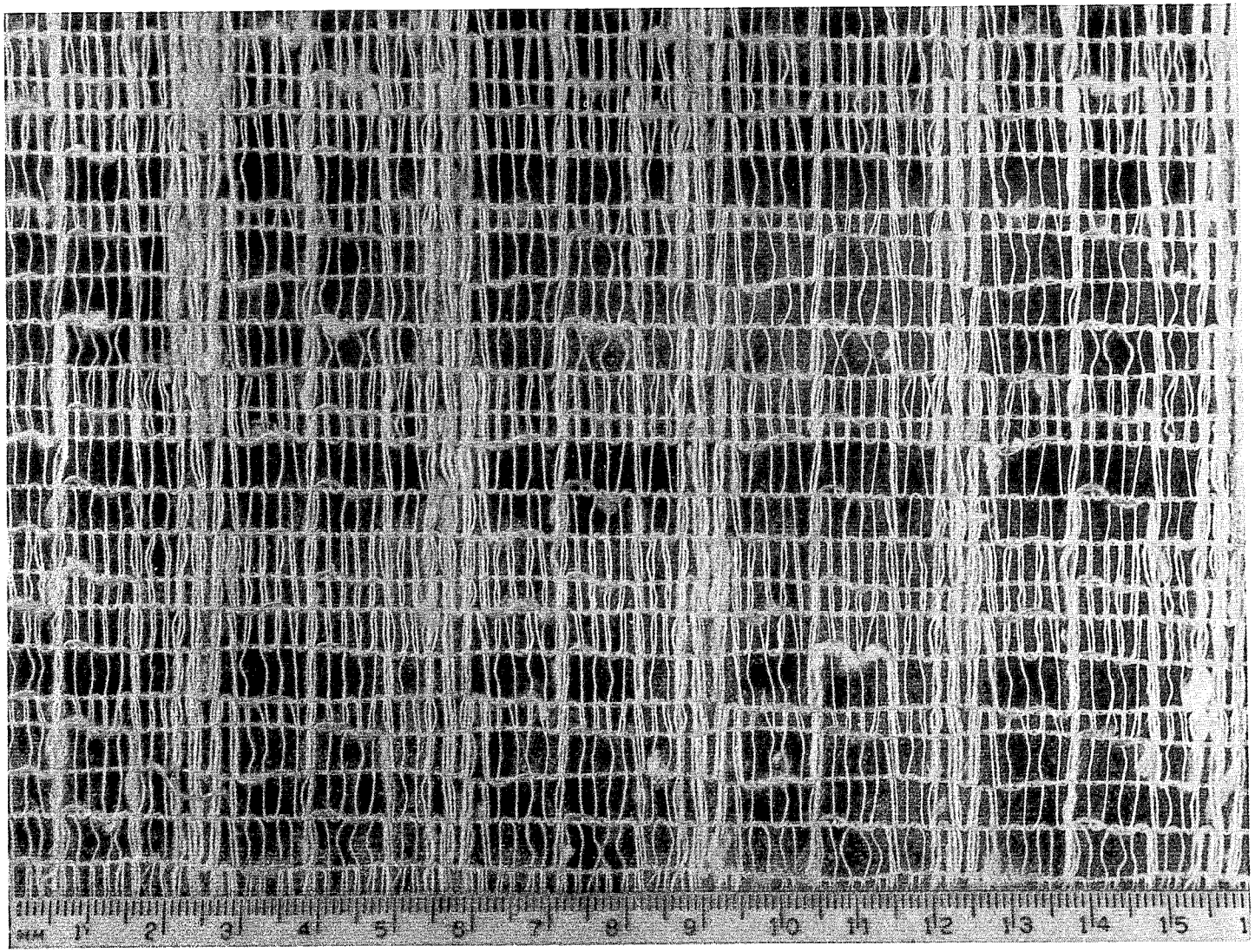

Turning now to the base fabric, shown in FIG. 7, attention is directed to FIGS. 4 and 5 and the preferred yarn patterns set forth therein. As is clear from a look at the fabric in FIG. 7, and as is conventional in warp knit fabrics, a plurality of yarns or a first group of yarns is formed into a plurality of chain stitches extending lengthwise along the fabric in the machine direction. While the formation of chain stitches by a warp knitting machine is conventional, bar 1 of a five or six bar raschel machine could be used to guide that first group of threads or yarns which are formed into the chains. The yarn is preferably a 330 denier, 66 filament compacted or filament entangled, semi-dull, set textured yarn such as Celanese type D-282 FORTREL Polyester. Such a yarn will usually be threaded within each thread guide in the bar and the threading could be such that in the selvage area the last end is doubled. Typically, the shogging action for producing the stitch chains is 2-0/0-2//.

FIG. 4 sets forth the preferred pattern of the ground yarn which, in conjunction with the chain yarns and the yarns set forth in FIG. 5 produce the sheer fabric shown in FIG. 7. The repeating pattern of the ground or base yarn, as set forth in FIG. 4, is comprised of six yarns designated Y1–Y6. This yarn is preferably a 10/1 spun rayon yarn and one repeat of threadup for the thread bar, for example, bar 5, is preferably as follows: 1 in, 1 out, 1 in, 1 out, 2 in, 2 out, 2 in, 2 out.

With reference again to FIG. 4, the vertical chain stitches are shown in phantom and the above threading arrangement produces the pattern shown in FIG. 4. Yarn Y1 begins at a given wale and is the "1 in" yarn referred to in the threading arrangement set forth above. There is no yarn introduced at the next wale and accordingly that corresponds to the "1 out" designation in the threading arrangement for bar 5. The next "1 in" reference is to yarn Y2 introduced in the next wale while the following wale, which is skipped, corresponds to the next "1 out" designation. Yarns Y3 and Y4 are introduced at the next two successive wales and these correspond to the first "2 in" designation. The next two wales are skipped which corresponds to the first "2 out" designation. Yarns Y5 and yarns Y6 begin on the next two wales and together correspond to the second "2 in" requirement and the skipping of the next two successive wales before another Y1 yarn begins the next repeat corresponds to the last "2 out" designation.

The bar controlling the feeding of this ground yarn is shogged in repeating pattern, which can be, for example 0-0/8-8//.

The selvage portion for the ground yarn, as controlled by bar 5, can be threaded for the right hand selvage as follows: 2 double, 2 out, 1 double, 1 single, 2 out, while the left hand selvage can be threaded 2 in, 2 out for three repeats.

The third yarn used to form the sheer or base fabric is shown in FIG. 5 and is the yarn most responsible for forming the weave look in the sheer fabric in FIG. 7. That yarn can be controlled by bar 4 of the knitting machine and the yarn is preferably a 3.25 open end spun rayon slubbed yarn. I prefer to employ several different shades, such as natural, cream and tan, as this provides a pleasant blended appearance. In threading the machine, thread bar and these colors should be mixed to avoid producing streaks in the fabric such as follows: the cream yarn can be placed next to the natural followed by the tan with the next repeat starting with the natural and then following with the cream and tan and so on across the machine. It should be understood, however, that if several colors are used, particular color repeats or yarn placement can be arranged in any desired fashion in order to achieve the desired look or effect wanted on the face of the fabric. This yarn is preferably threaded in a 1 in, 1 out sequence so that every other tube of the bar is threaded. Here again, if more or less density is desired, that threading arrangement could be changed. The selvage area for this yarn can involve a bar thread-up for the right selvage of "1 in" and "1 out" and "5 in" for the left selvage.

This yarn is controlled in its movement so that the end result appears as shown diagrammatically in FIG. 5 which produces a stepped like appearance which will extend throughout the fabric. The fabric repeat can begin, for example, at the letter A with the yarn being shogged in the following pattern from A to B over five courses; 0-0/2-2/2-2/0-0/0-0/. The yarn will then move from point B to point C, in one course and from C to D over another five course area. The shogging motion from C to D can be 8--b 8/6-6/6-6/8-8/8-8. Moving from D to E, the yarn will be moved back to a 2-2 position and in the next course, from point F to point G, the yarns moved outwardly to a 12-12 position for one course beyond the boundary established by the vertical portion on the left side of the pattern extending from C to D and K to L. In the next course, extending from H to I, the yarn is moved back to a 0-0 position which establishes along with the run between A and B the right side boundary of the pattern shape. In the next course, extending from J to K, the yarn will move back to the 8-8 position and from K to L the shogging motion can be: 8-8/6-6/8-8//. Following the yarn's arrival at L, the pattern repeat will begin again and the yarn is shogged back to its initial A position at 0-0. Thus, the overall shogging description for this repeating pattern can be identified as follows: 0-0/2-2/2-2/0-0/0-0/8-8/6-6/6-6/8-8/8-8/2-2/12-12/0--0/8-8/6-6/8-8//.

The portion of this pattern which extends from F through G and H and back to I, as can be seen by the two yarns shown in FIG. 5, produces a horizontal stripe that extends across the fabric in a cross-machine direction. As indicated above, the boundaries of the pattern are established by yarn runs from A to B and I to J on one side and by C to D and K to L on the other side. Thus, a box or step like pattern with many horizontal lines is produced by the portions extending from L to A, initially, and between B and C, D and E and K and J. Each of these horizontal areas produces a much more visual horizontal impression rather than a vertical impression so that the overall appearance of the fabric is more horizontal and thus woven with the portion extending from F to I forming distinct horizontal areas in the fabric.

By combining the chain stitch previously discussed together with the yarn pattern set forth in FIGS. 4 and 5, for the ground and weave effect yarns, respectively, it is possible to produce a woven-like sheer fabric that can be used directly as sheer drapery material. Thus, a warp knit machine has been used to produce what would appear to be a woven product. This, of course, presents many manufacturing advantages and this sheer fabric is used as a base to make complimentary heavier weight fabrics that also can be used as drapery material and especially drapery material that can be used in conjunction with the sheer material just described to form a double drape system compatible in styling and color. Further, the change over from manufacturing one to the other is extremely simple as no thread-up or yarn changes is required.

Figure 6:
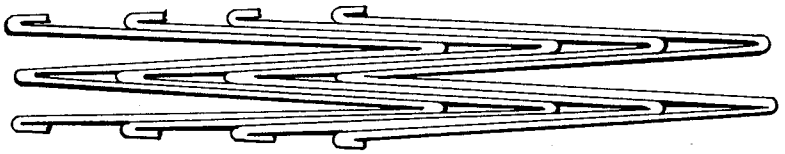
FIG. 6 is a diagrammatic view of two courses of the backing yarn which can be incorporated into the sheer fabric made according to the present invention.

The sheer or base fabric can be provided with a self-lining with yarns arranged in a pattern as shown in FIG. 6. The lining yarns can, for example, be controlled by bar 6 in the warp knitting machine with the yarns forming the backing material again being the 330/66/C semi-dull, set textured type D-282 FORTREL Polyester yarn as was used to make the chain stitches. The bar will again have all of the thread guides threaded and the selvage can have the first two and last three yarns doubled in order to produce a stronger selvage. The knitting of this yarn preferably occurs with little or no tension on this yarn so that it can bloom to the fullest extent possible. The color is preferably white so that there will be no color repeats and the color will be solid throughout the bar. The shogging motion can be 10-10/0-0// so that the yarns will run back and forth over five wales. It should be pointed out that the self-lining yarns or threads are actually introduced on the technical front face of the knit fabric but in the fabrics finished form this becomes the rear face or surface of the fabric.

Figure 9:
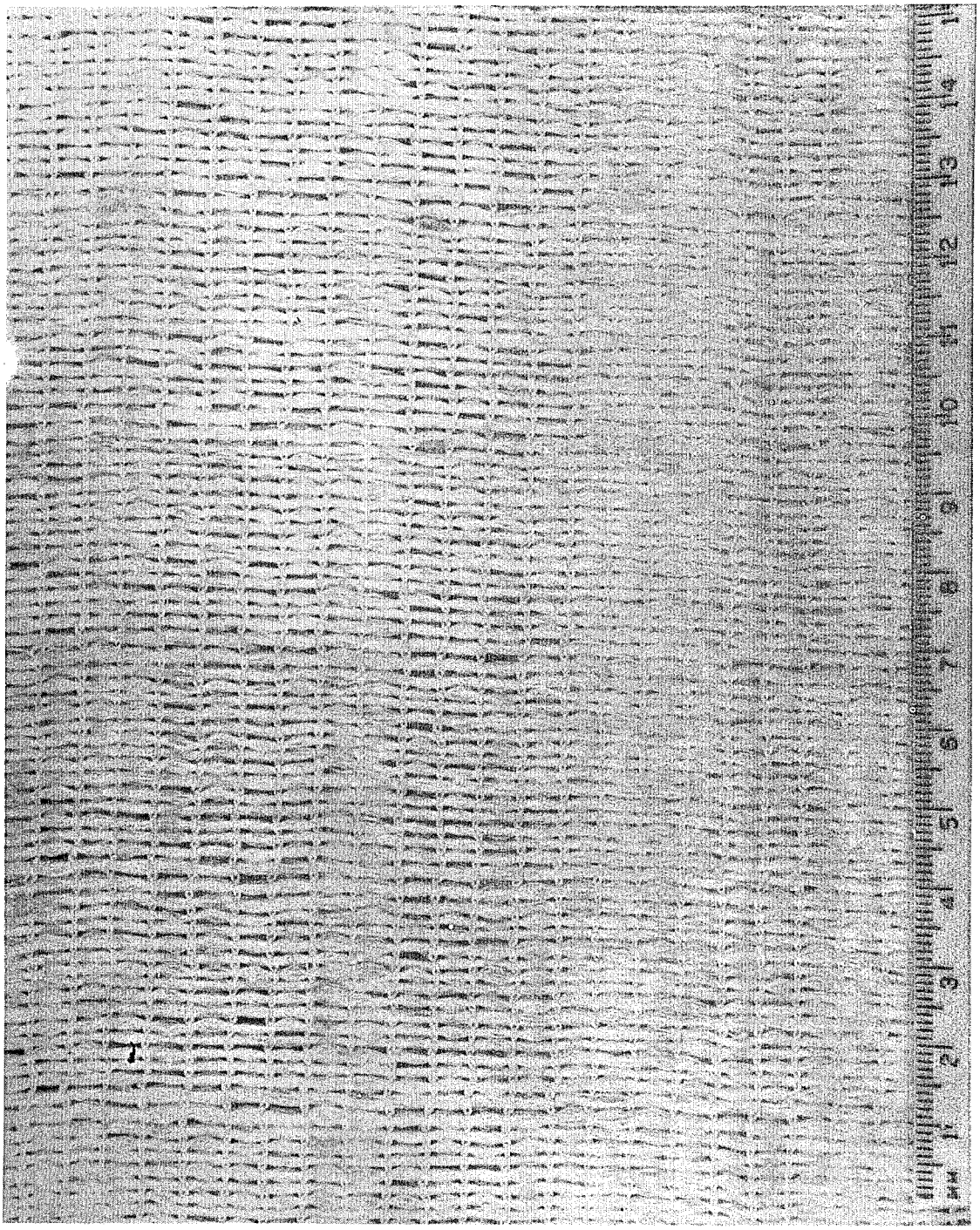
FIG. 9 is a photograph of the self-lining on the rear face of the fabric shown in FIG. 8.

The rear face of the fabric showing the effect of incorporating such self-lining yarns is shown in FIG. 9 and if a very highly blooming yarn is used the resulting effect is to completely fill out the rear portion of the fabric. It should be noted that the application of this self-lining to the sheer fabric can be accomplished by merely beginning the introduction of this additional yarn while making the sheer fabric so that no other changes in machine operation or control need to be made.

In the past, it has been known to use a non-woven material such as DELNET as a backing for such fabrics. DELNET is a nonwoven dry bonding fabric formed from high-density polyethylene or polypropylene which can be applied by heated calender systems. It has been found, however, that when used in drapery materials the material not only adds a great deal of expense to the product, but delamination is very frequent and it was not possible to hold consistent finished widths for drapery material, which is significant in the drapery area as consistent width goods is important to achieve uniform results when manufacturing drapes. Since such non-woven bonding materials are applied by heat, the material tended to shrink during bonding and, accordingly, dramatically changed the finished widths. Further, because such materials require some amount of melting and rehardening, the resulting fabric was not left with a pleasant or desirable soft hand but were rendered rather stiff. Further, if melting temperatures were too great or not closely controlled, bonding material could squeeze through to the front face of the fabric making a very rough outer surface which is also undesirable. Also, the loft and bulkiness desirable in the fabric made according to the present invention was flattened during the passage of the fabric through the calender rolls required to apply such non-woven bonding materials.

By incorporating the backing yarns as shown in FIGS. 6 and 9, a very full, dense fabric is produced which has a very good soft hand. The fabric is less expensive to produce because the lining is introduced directly during fabric manufacture rather than an additional step. Subsequent processing of the fabric is reduced and does not flatten the loft and bulkiness of the fabric. Accordingly, the hand and yarn appearance remains soft and bulky so that the overall visual effect of the resulting fabric is very pleasing and desirable.

Figure 10:
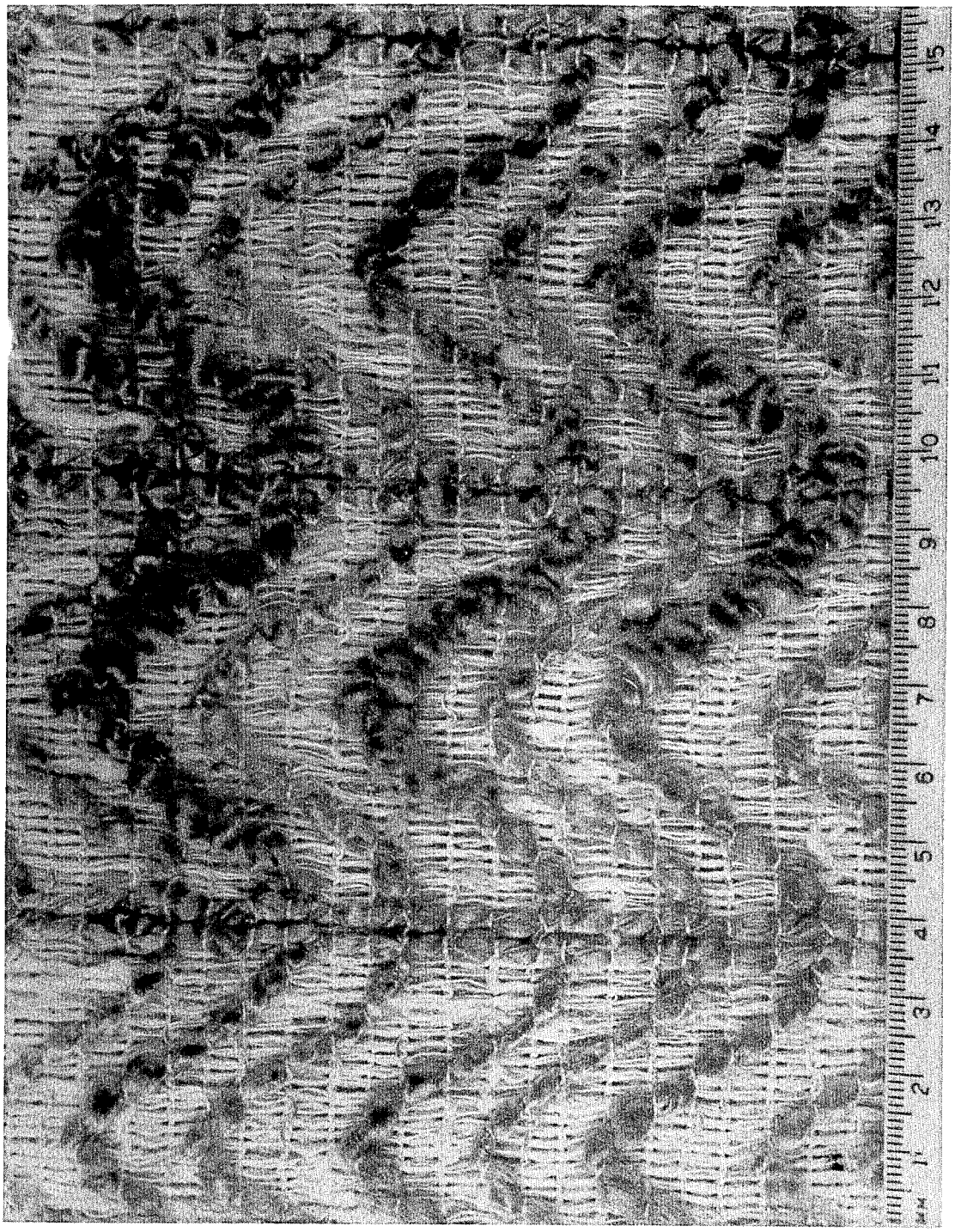
FIG. 10 is a photograph of the face of another exemplary fabric made according to the present invention.

Turning attention now to FIG. 10, an alternative exemplary fabric is shown which again incorporates the base or sheer fabric shown in FIG. 7, the backing yarns as shown in FIG. 9 and the top effect yarns. The top effect yarn now, however, is moved in a zig-zag pattern and to produce this pattern the shogging action of the bar guiding the top effect yarn can be as follows: 0-0/0-0/10-10/10-10/0-0/0-0/2-2/2-2/4-4/4-4/6-6/6-6-/8-8/8-8/8-8/10-10/10-10/10-10/12-12/12-12/10-10/1-0-10/10-10/8-8/8-8/6-6/6-6/4-4/4-4/2-2/2-2//.

Turning now to FIGS. 11–15, various additional aspects of the present invention, principally involving use of the wale wise extending top effect yarn, will be described. Here, the base fabric is now of a more conventional type. For example, in FIG. 15 the base fabric is constructed using regularly spaced warp yarns formed into parallel chain stitches chains using 170 denier textured polyester and, likewise, regularly spaced single weft or filling ends such as 10/1 natural spun rayon yarns.

Figure 11:
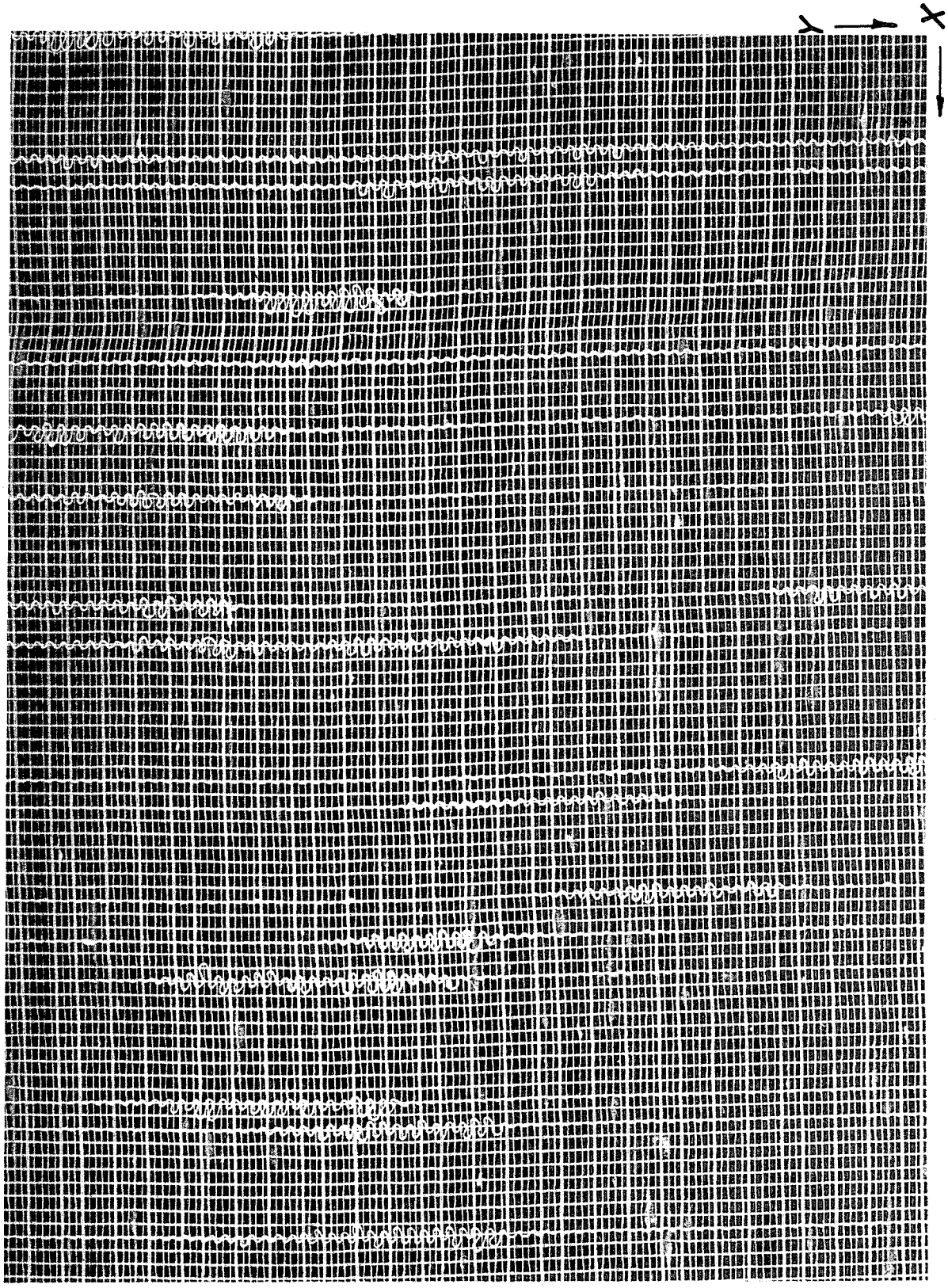
FIG. 11 is a photograph of another exemplary fabric according to the present invention where the base is formed from fill ends and warp chains with nubbed yarns in the fill direction and warp direction novelty ends formed during knitting.
Figure 13:
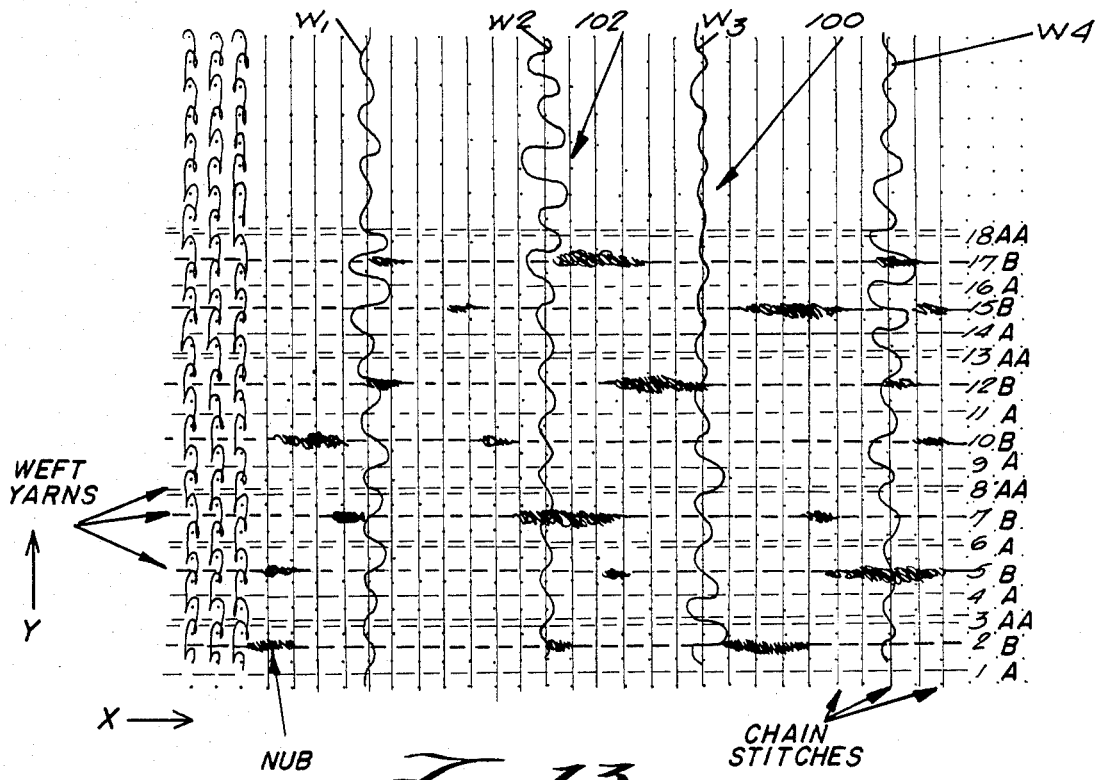
FIG. 13 is a point paper sketch of the fabric construction shown in FIG. 11.

The base fabric used in the fabric shown in FIG. 11 is constructed according to the diagram or sketch shown in FIG. 13 and the warp or machine direction is shown by the Y arrow and the weft, fill or cross-machine direction is shown by the X arrow. When using a conventional weft carrier with eighteen guide positions, a typical arrangement for the fill yarns would be as characterized by the "A", "B" and "AA" designations where the "AA" designation would be two of the "A" ends. "A" could be a 10/1 natural spun rayon yarn while "B" could be a natural 8/1 rayon acrylic nub yarn. It should be understood that the above combination of specific yarn ends in various ones of the weft carrier guide positions is but one of a wide variety of such arrangements, likewise the yarns designated are only exemplary as well, and the present invention, in terms of the warp knit base fabric, is intended to be all inclusive of this and ohr warp knit constructions.

The top effect yarns, as for example are shown by exemplary yarns $w_1$–$w_4$, can be laid in under normal tension conditions to simply run along the chain stitches from one side to the other, as indicated at 100. When it is laid in under a reduced or released tension, the top effect yarn can freely flow under its own weight and through the action of its guide bars and/or guide tubes to lay itself between wales and will, under its own weight, fall in an excessive albiet irregular quantity to produce the irregular or random slub or ratine effect as indicated at 102. It should be noted from FIGS. 11 and 13 that the yarn position within the ratine area 102 is irregular or random which helps produce the desired effects. Subsequently as tension is reapplied the top effect yarn will again become tensioned and simply run along the chain stitches from one side to the other.

Yarn "B" is a previously prepared nub yarn and the combined effect with the ratine top effect yarn is a sheer fabric with ratine slubs appearing in the warp direction and nubs in the weft or filling direction.

In this fabric the top effect yarn can be a 10/1 spun rayon and with even such a fine yarn, the random tensionless flow of that yarn produces the ratine-like portions. A convenient and practical range for light top effect yarns would include yarns varying from about 20 to about 1000 denier or from about a cottom count of 100 to about 0.5. However, it should be understood that other sizes or deniers of yarns could be used as well.

While this invention permits the obtaining of novel effects from regular yarn ends, the top effect yarn could itself be a single or double yarn, a plied or textured or various combinations thereof. Likewise, it could be a spun, filament, textured filament or a combination or even a novelty yarn formed with slubs, nubs or other conventional novelty effects or combinations.

The guide bar or tube system for the top effect yarn is, of course, being moved back and forth across a predetermined number of wales or chain stitches and that action together with the free flowing yarn produces the top yarn effect shown when the top effect yarn is fed while tension is released. When tension is reapplied the ratine-like effect is progressively reduced until the yarn again is simply laid under normal tension. It should be noted that in FIGS. 13, 14 and 15 the chain stitches have been shown or drawn in detail in only the first three vertical wales. Throughout the rest of the sketch, the chain stitches have been drawn in the form of vertical lines for simplification to show the nature of the top effect lay-in procedures.

Figure 12:
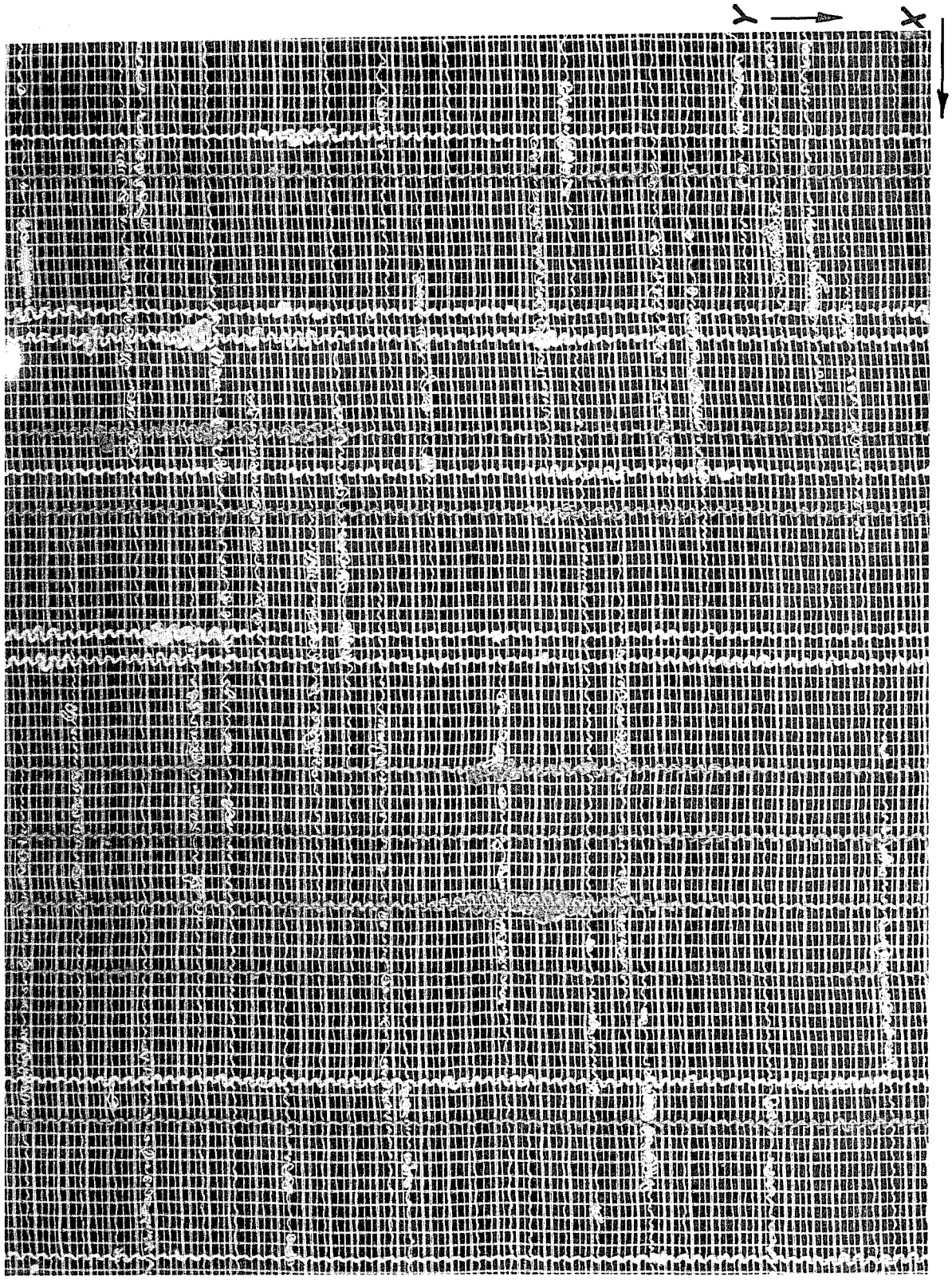
FIG. 12 is a photograph of another exemplary fabric according to the present invention where the base is formed from fill ends and warp chains with slub yarns extending in the full direction and warp direction novelty ends formed during knitting.
Figure 14:
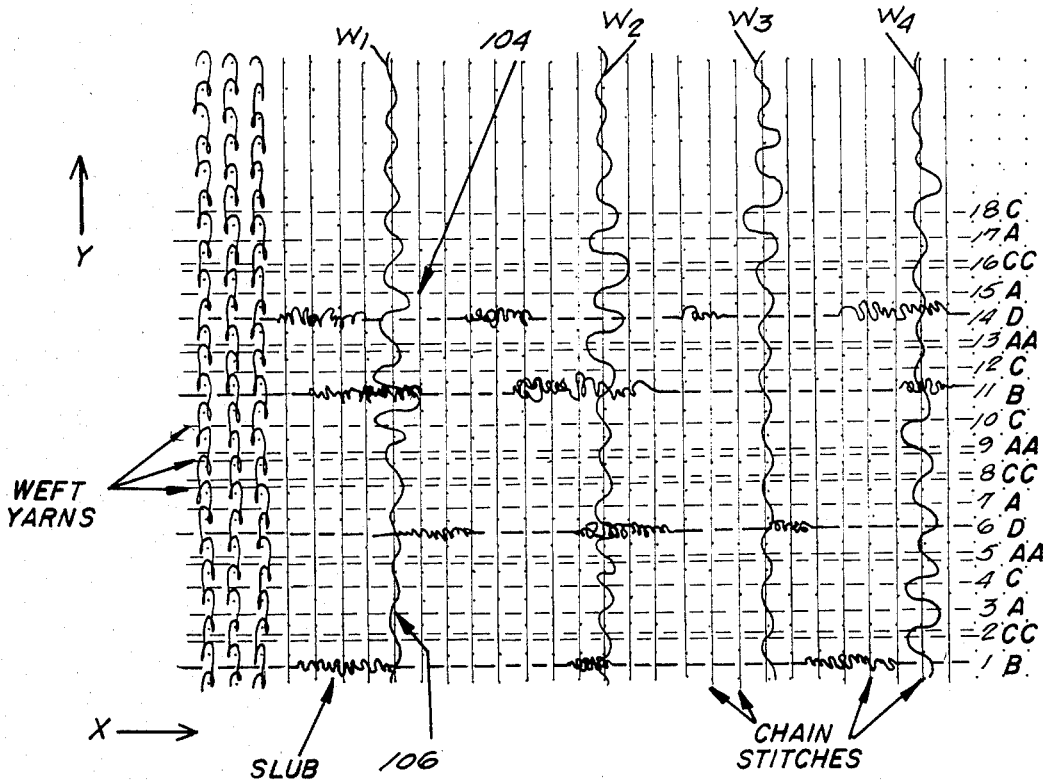
FIG. 14 is a point paper sketch of the fabric construction shown in FIG. 12.
Figure 15:
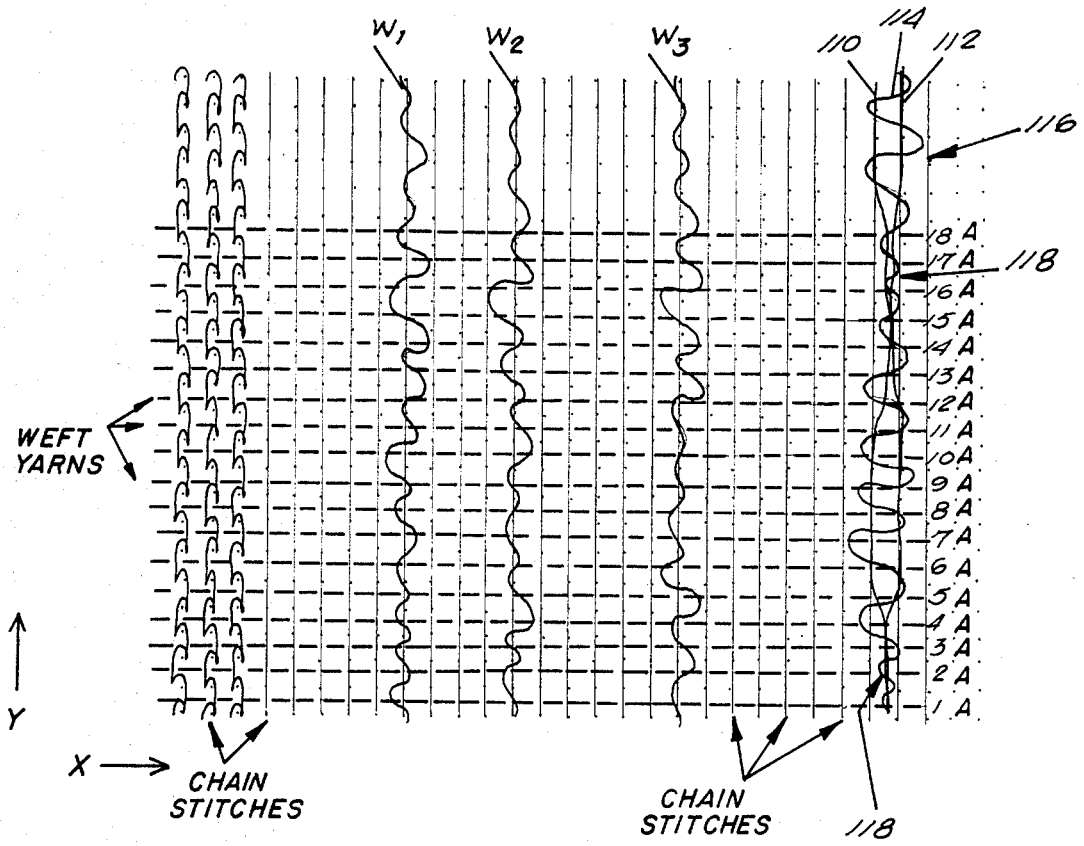
FIG. 15 is a point paper sketch of additional fabric construction examples according to the present invention.

Turning now to FIGS. 12 and 14 a more involved fabric is shown. Here, the fill yarns are designated as "A", "AA", "B", "C", "CC" and "C" and can comprise following type yarns: "A" a 10/1 natural spun rayon; "B" a natural plied slub effect yarn having a total yield of 3662 comprised of two ends of 26/1 spun rayon over fed with one end of 10/1 spun rayon; "C" is a dyed 10/1 spun rayon; and "D" is also a plied slub effect yarn similar to "B" but dyed.

As shown on the right side of FIG. 14 the weft carrier is threaded across the eighteen positions beginning at position 1 with yarn "B" and ending at position 18 with yarn "C". However, it should again be understood that this fabric is only exemplary and that other weft yarn threading and yarn end type combinations are possible and are intended to be included herein. The chain stitches again run in the warp or machine direction, indicated by the Y arrow in FIG. 12. Also, the top effect yarns $w_1$–$w_4$ extend in the warp or machine direction and are formed into ratine-like slub portions, as indicated at 104, when tension is released. However, the top effect yarn runs along the chain stitches when tension is applied, as indicated at 106. As the tension is varied, randomly or in some other predetermined fashion, various effects can be achieved. In FIG. 12 to heighten the ratine-like slub effect, the top effect yarn is a dyed 3.24 spun rayon slub yarn and at points where the top effect yarn is formed into the ratine-like slub where the yarn itself includes a slub, very broad coverage effects will be produced.

Returning again to FIG. 15, two warp chain stitches are shown at 110 and 112. The top effect yarn 114 here is guided so that it moves back and forth under both chain stitches 110 and 112. At a point indicated at 116, the tension on the effect yarn is released, "normal" in this instance, while at a point indicated at 118, tension has been applied. While tension is "normal" or released, the chain stitches 110 and 112 occupy their expected positions, parallel to and spaced from one another, with yarn 114 laid thereunder but within each of the two chains. As tension is increased, the laid-in yarn 114 causes the stitch loops in which it is held to be tensioned horizontally which in turn causes the two chain stitches to slide along the weft yarns toward one another thus producing the effect shown at 118 where the two chain stitches are adjacent or directly next to one another. Thereafter, as tension is again released, the tension applied to the chain stitch yarns positions the chain stitches back to their normal or original, spaced apart locations, as at 116.

Depending on the size or type of effect yarn used as well as the tension applied, which can vary to produce the desired visual effect, the top effect yarn can be seen prominently on the surface or it could be hidden so that the changes in the chain stitches is the predominate feature or alternatively some combination thereof.

Figure 8:
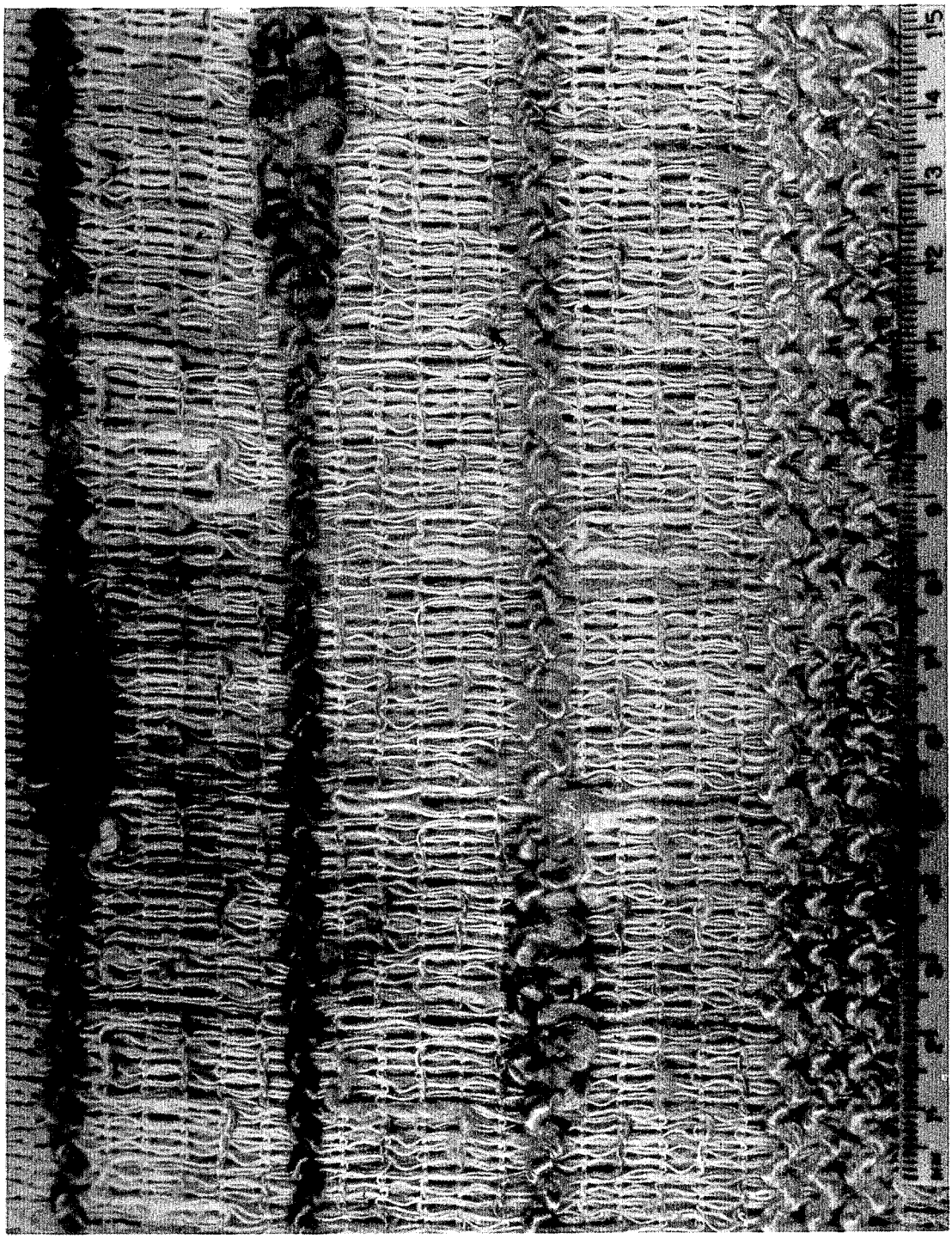
FIG. 8 is a photograph of the face of an exemplary full weight fabric made according to the present invention which includes both the base or ground fabric shown in FIG. 7 together with the backing yarn shown in FIG. 6 and the top effect yarns shown in FIG. 1.

The present invention, therefore, discloses a plurality of fabrics beginning with a novel, woven-like sheer fabric, shown in FIG. 7, and ending with the full weight fabrics shown in FIGS. 8 and 10 formed using the woven-like base of FIG. 7 as well as the novel constructions shown in FIGS. 11–15. Because each of these is a warp knit fabric, the creation of chain stitches and the knit construction yield some amount of stretch in the machine direction which allows the fabric to be overfed during finishing and brought to uniform widths, making them ideal for use as many end uses benefit from having fabric that is uniformly wide. Standard finishing techniques can be used to finish the fabric and this includes the use of conventional resin treatments which are heat set at finishing temperatures ranging from 360 to 380 degrees F.

Thus, the present invention produces a wide variety of warp knit fabrics that create many visual appearances and allows the use of regular yarns to achieve novel top or surface effects or the use of novelty yarns, the effects of which can be increased. Likewise, each of the fabrics can include the self-lining backing yarns as shown in FIG. 9. Also, many colors and combinations thereof can be used and when knit according to the instructions discussed hereinbefore can produce fabrics that do not include vertical stripes, but rather is comprised of a balanced construction with each chain stitch supporting about the same amount or quantity of yarn. Further, by use of the tensioning apparatus controlled as described above, the top effect yarns can be applied to produce novel effects such as the forming of regular yarn into a ratine-like slubbed yarn with the tensioning apparatus allowing normal tension with a quick release from normal to zero tensions and vice versa.

While the invention has been described in connection with what is presently considered to be the most practical and preferred embodiment, it is to be understood that the invention is not to be limited to the disclosed embodiments, but on the contrary, is intended to cover various modifications and equivalent arrangements included within the spirit and scope of the appended claims, which scope is to be accorded the broadest interpretation so as to encompass all such modifications and equivalent structures.

What is claimed is:

1. A warp knit fabric having woven-like characteristics comprised of a plurality of chain stitches extending in the machine direction of the fabric, a plurality of weft yarns extending in the cross-machine direction and at least one top effect yarn laid into at least one of said chain stitches, said top effect yarn being a non-slubbed yarn and being bunched at random intervals in dependence upon varied tension of the top effect yarn along the machine direction, said top effect yarn exhibiting the appearance of ratine-like slub effect yarn due to the varied tension thereof.

2. A fabric as in claim 1 wherein the top effect yarn is light weight yarn.

3. A fabric as in claim 1 wherein said top effect yarn is a single yarn.

4. A fabric as in claim 1 wherein the top effect yarn is a double yarn.

5. A fabric as in claim 1 wherein the top effect yarn is a plied yarn.

6. A fabric as in any one of claims 1–5 wherein said top effect yarn is a filament yarn.

7. A fabric as in any one of claims 1–5 wherein said top effect yarn is a spun yarn.

8. A fabric as in any one of claims 1–5 wherein said top effect yarn is a textured yarn.

9. A fabric as in any one of claims 1–5 wherein said top effect yarn is a novelty yarn.

10. A fabric as in claim 9 wherein said novelty yarn is a slubbed yarn.

11. A fabric as in claim 9 wherein said novelty yarn is a nub yarn.

12. A fabric as in claim 1 further including novelty weft yarns at predetermined positions.

13. A fabric as in claim 1 further including a self-lining yarn knit on the surface of the fabric forming the rear face of the finished fabric.

14. A warp knit fabric comprising a base fabric formed from a plurality of warp and weft yarns, and at least one top effect yarn secured onto the fabric, said top effect yarn having varied tensions in the machine direction and exhibiting the appearance of a ratine-line slub effect yarn in dependence upon the amount of tension, said top effect yarn being randomly doubled-back and bunched together at intervals along its length to give the appearance of a ratine-like or boucle type slub effect, wherein said top effect yarn extends back and forth relative to at least two chain stitches, said at least two chain stitches spaced apart and pulled forwardly relative to one another by virtue of the varied tension feeding of said top effect yarn.

15. A fabric as in claim 14 wherein the top effect yarn is a light weight yarn.

16. A fabric as in claim 14 wherein the top effect yarn is a single yarn.

17. A fabric as in claim 14 wherein the top effect yarn is a novelty yarn.

18. A fabric as in claim 14 further including a novelty weft yarn at predetermined locations.

19. A process for producing a warp knit fabric on a warp knitting machine comprising the steps of simultaneously feeding a plurality of warp and weft threads and interknitting said weft threads with said warp threads while forming said warp threads into a plurality of chain stitches and laying in a non-slubbed top effect yarn within predetermined ones of said plurality of chain stitches, said laying in of said top effect yarn being practiced by randomly tensioning and untensioning said top effect yarn independently of the yarn tensioning requirements at the knitting machine to randomly bunch a quantity of said top effect yarn in the warp direction so that the top effect yarn exhibits the appearance of a slub effect yarn.

20. A process of froming a novelty warp knit characteristics comprising the steps of forming a base fabric by knitting together a plurality of warp and weft yarns, introducing a plurality of non-slubbed top effect yarns, securing the top effect yarns onto the fabric and irregularly varying the tension at which the top effect yarns are fed independently of the yarn tensioning requirements at the knitting machine so that varying amounts of the top effect yarns are secured to the fabric randomly in the warp direction, said top effect yarns by virtue of said varying amounts thereby exhibiting the appearance of slub-effect yarns.

21. A process as in claim 19 wherein the step of randomly tensioning and untensioning the top effect yarn is practiced so that when tension is released, the said predetermined ones of said plurality of chain stitches remain spaced apart and are pulled forward relative to one another as tension is increased on said top effect yarn.

22. A process for forming a novelty warp knit fabric comprising the steps of forming a base fabric by knitting together a plurality of yarns on a knitting machine, feeding a plurality of top effect yarns from a creel, introducing said plurality of top effect yarns into the knit fabric by laying them in on the front face of the fabric at predetermined points, securing the top effect yarns onto the fabric at said predetermined points and varying the amount of top effect yarn being secured to the fabric by irregularly varying the tension at which the top effect yarns are fed independently of yarn tensioning required at the knitting machine.

23. A process for forming a novelty warp knit fabric on a warp knitting machine comprising the steps of forming a base fabric from a plurality of yarns, feeding a plurality of plain effect yarns from a creel spaced from the warp knitting machine, randomly controlling the tension on the plain top effect yarns at the creel so that the plurality of plain top effect yarns are laid and secured onto the face of the base fabric in irregular amounts and in an irregular fashion thereby allowing the top effect yarns to be formed with the appearance of novelty type yarns.

24. A process as in claim 22 or 23 including the further step of introducing a plurality of self-lining yarns into the fabric by laying in said lining yarns and securing them in place on the side thereof opposite the top effect yarn.

25. A process as in claim 24 including the step of laying the top effect yarns so that they appear like ratine yarns.

26. A process as in claim 24 including the step of laying the top effect yarns so that they appear like slubbed yarns.

27. A warp knit fabric comprising a base fabric formed on a warp knitting machine from a plurality of yarns, and at least one top effect yarn extending along and secured within at least one wale in the wale-wise direction of the fabric, said top effect yarn having random intervals of varying tension along its length, said top effect yarn being gathered in greater or lesser quantities at said intervals by virtue of said varying tension to produce the appearance of a ratine-like slub effect yarn, said top effect yarn also extending back and forth relative to at least one row of stitches in which it is held.

28. A warp knit fabric comprised of a plurality of chain stitches extending in the warp-wise direction of the fabric, a first plurality of in-laid ground effect yarns extending in a series of repeating patterns primarily in the course-wise direction and a second plurality of in-laid yarns inserted at and along predetermined wales so that they extend primarily horizontally in a repeating stepped pattern throughout the fabric which is given the appearance of being woven as a result of the horizontal pattern of the second in-laid yarn including a third plurality of in-laid self-lining effect yarns laid onto that surface of the fabric forming the rear face of the finished fabric.

29. A fabric as in claim 28 wherein the third plurality of in-laid self-lining effect yarns are introduced at every wale.

30. A fabric as in claim 28 wherein each of the third plurality of in-laid self-lining effect yarns extends across about five wales.

31. A process for forming a novelty warp fabric comprising the steps of forming a base fabric by knitting together a plurality of yarns on a knitting machine, feeding a plurality of top effect yarns from a creel, introducing said plurality of top effect yarns into the knit fabric by laying them in on the front face of the fabric at predetermined points, securing the top effect yarns onto the fabric and irregularly varying the tension at which the top effect yarns are fed independently of yarn tensioning required at the knitting machine so that varying amounts of the top effect yarns are secured to the fabric and introducing a plurality of self-lining yarns into the fabric by laying in said lining yarns and securing them in place on the side thereof opposite the top effect yarns.

32. A process for producing a warp knit fabric comprising the steps of:

(a) simultaneously feeding a plurality of warp and weft threads and interknitting said weft threads with said warp threads while forming said warp threads into a plurality of chain stitches; and (b) laying in a plain top effect yarn within predetermined ones of said plural chain stitches by randomly tensioning and untensioning said top effect yarn to impart a novelty effect appearance thereto, said tensioning and untensioning being practiced so that when tension is released, said predetermined stitches remain spaced apart and are pulled forward relative to one another as tension is increased on said top effect yarn.

* * * * *